US007202203B2

(12) United States Patent
Ushio et al.

(10) Patent No.: US 7,202,203 B2
(45) Date of Patent: Apr. 10, 2007

(54) SOFTENER COMPOSITION

(75) Inventors: Noriaki Ushio, Wakayama (JP); Hiromitsu Hayashi, Wakayama (JP); Shuji Tagata, Wakayama (JP)

(73) Assignee: Kao Corporation, Tokyo (JP)

( * ) Notice: Subject to any disclaimer, the term of this patent is extended or adjusted under 35 U.S.C. 154(b) by 153 days.

(21) Appl. No.: 10/440,165

(22) Filed: May 19, 2003

(65) Prior Publication Data

US 2003/0216276 A1 Nov. 20, 2003

Related U.S. Application Data

(62) Division of application No. 09/936,929, filed as application No. PCT/JP01/00286 on Jan. 18, 2001, now Pat. No. 6,596,685.

(30) Foreign Application Priority Data

Jan. 19, 2000 (JP) ..... 2000-9721
Jan. 19, 2000 (JP) ..... 2000-9722
Jun. 29, 2000 (JP) ..... 2000-196882

(51) Int. Cl.
*C11D 7/32* (2006.01)

(52) U.S. Cl. ..... 510/476; 510/504; 510/515

(58) Field of Classification Search ..... 510/515, 510/475, 341, 321, 516, 509, 500, 466, 350
See application file for complete search history.

(56) References Cited

U.S. PATENT DOCUMENTS

| | | | | |
|---|---|---|---|---|
| 2,970,158 A | | 1/1961 | Levis, Jr. | |
| 4,126,562 A | * | 11/1978 | Goffinet et al. | 510/526 |
| 4,155,855 A | | 5/1979 | Goffinet et al. | |
| 4,333,862 A | | 6/1982 | Smith et al. | |
| 4,439,331 A | | 3/1984 | Billenstein et al. | |
| 4,442,013 A | | 4/1984 | Fraikin et al. | |
| 4,447,343 A | | 5/1984 | May et al. | |
| 4,548,744 A | * | 10/1985 | Connor | 510/350 |
| 4,561,998 A | * | 12/1985 | Wertz et al. | 510/350 |
| 4,622,378 A | * | 11/1986 | Gosselink | 528/66 |
| 4,846,982 A | * | 7/1989 | Madore et al. | 510/330 |
| 5,205,960 A | | 4/1993 | Kristopeit et al. | |
| 5,670,472 A | | 9/1997 | Keys | |
| 6,022,844 A | | 2/2000 | Baillely et al. | |
| 6,211,139 B1 | | 4/2001 | Keys et al. | |
| 6,596,685 B2 | * | 7/2003 | Ushio et al. | 510/504 |

FOREIGN PATENT DOCUMENTS

| | | |
|---|---|---|
| EP | 0082457 | 6/1983 |
| EP | 0351769 A2 | 1/1990 |
| EP | 0125103 | 8/1990 |
| GB | 2260997 A | 5/1993 |
| GB | 2320714 A | 7/1998 |
| JP | 86037387 | 8/1986 |
| JP | 92028826 | 5/1992 |
| JP | 5132865 | 5/1993 |
| JP | 07018569 | 1/1995 |
| JP | 07018571 | 1/1995 |
| JP | 95023584 | 3/1995 |
| JP | 07229061 | 8/1995 |
| JP | 07268773 | 10/1995 |
| JP | 08246343 | 9/1996 |
| JP | 09111660 | 4/1997 |
| JP | 09250085 | 9/1997 |
| JP | 10506966 | 7/1998 |
| JP | 11507095 | 6/1999 |
| JP | 11217585 | 8/1999 |
| JP | 11350349 | 12/1999 |
| WO | 9533033 A1 | 12/1995 |
| WO | WO9927050 | 6/1999 |

* cited by examiner

*Primary Examiner*—Gregory E. Webb
(74) *Attorney, Agent, or Firm*—Birch, Stewart, Kolasch & Birch, LLP

(57) ABSTRACT

The softener composition of the present invention comprises a compound having one or more $C_{8-36}$ hydrocarbon groups and two or more groups selected from an amino group and a quaternary ammonium group in the molecule (component (a)), an anionic surfactant having a $C_{8-36}$ hydrocarbon group (component (b)) and a nonionic surfactant (component (c)), wherein the molar ratio of the component (a) to the component (b) is from 90/10 to 50/50. This softener composition can endow cotton and cotton clothes in particular with a preferred softness, elasticity (fluffy feeling) and feeling of dryness with small oiliness.

6 Claims, No Drawings

SOFTENER COMPOSITION

This application is a divisional of application Ser. No. 09/936,929, filed on Sep. 19, 2001, now U.S. Pat. No. 6,596,685, and for which priority is claimed under 35 U.S.C. §120. Application Ser. No. 09/936,929 is the national phase of PCT International application No. PCT/JP01/00286, filed on Jan. 18, 2001 under 35 U.S.C. §371. This application also claims priority of application No. 2000-9721, 2000-9722 and 2000-196882, filed in Japan on Jan. 19, 2000, Jan. 19, 2000 and Jun. 29, 2000, respectively, under 35 U.S.C. §119.

TECHNICAL FIELD

The present invention relates to a softener composition for textiles.

BACKGROUND ART

At present, domestic softener compositions are compositions based on a quaternary ammonium compound containing two long-chain alkyl groups in one molecule and being typified by di(hydrogenated tallow alkyl)dimethyl ammonium. The reason for use of such softener compositions is that the quaternary ammonium compound, even in a small amount, has a good softening effect on various fibers. However, these softener compositions suffer from the problem of oily finish of fibers and deterioration in water absorption properties of cotton towels etc.

JP-B 4-28826 and JP-B 7-23584 disclose the technique of using a quaternary ammonium salt having an unsaturated alkyl chain as the means of improving water absorption properties, by which the water absorption properties of cotton towels are improved, but slimy feeling peculiar to the quaternary ammonium salt is still not solved.

JP-A 9-111660 describes use of a mixture of a polycation having at least one long-chain hydrophobic group and an anionic surfactant, but this technique also failed to satisfy water absorption properties and preferable feeling.

On the other hand, there is the problem that discoloration of clothes proceeds by repeated washing, resulting in deterioration in the appearance. This is due to the influence of residual chlorine present in tap water, and the technique of preventing discoloration by scavenging such residual chlorine has been found. JP-A 10-506966 discloses a softener composition comprising a chlorine scavenger. In respect of costs and storage stability, however, it was very unfavorable to incorporate a chlorine scavenger besides softening components into the softener composition.

As an automatic laundering machine becomes distributed in recent years, there is an increasing opportunity to use a softener composition by introducing it into an automatic inlet, but if conventional softening components are used, they will remain in the inlet thus forming gel with time to cause clogging in the inlet or the problem of an aesthetically unfavorable appearance.

DISCLOSURE OF INVENTION

The object of the present invention is to provide a softener composition endowing clothes with a high softening effect and preferable feeling without deteriorating the water absorption properties of textiles. Further, the present invention provides a softener composition capable of endowing cotton in particular with a preferred softness, elasticity (fluffy feeling) and feeling of dryness with small oiliness while being excellent in the discoloration-preventing effect.

Furthermore, the present invention can also provide a softener composition not causing gelation in an automatic inlet in a laundering machine.

That is, the present invention provides a softener composition which comprises a compound having one or more $C_{8-36}$ hydrocarbon groups and two or more groups selected from an amino group and a quaternary ammonium group in the molecule (component (a)), an anionic surfactant having a $C_{8-36}$ hydrocarbon group (component (b)) and a nonionic surfactant (component (c)), wherein the molar ratio of the component (a) to the component (b) is from 90/10 to 50/50.

The component (a) has a softener action.

Preferably, at least of the component (a) and the component (b) has at least one hydrocarbon group selected from:

<1> $C_{8-36}$ hydrocarbon group having one or more unsaturated bonds, and

<2> $C_{8-36}$ branched alkyl group.

Preferably, the component (a) is a compound having at least one $C_{8-36}$ hydrocarbon group, at least one quaternary ammonium group and at least one tertiary amino group, and the cation equivalent of quaternary ammonium group of the component (a) to the anion equivalent of the component (b) is from 90/10 to 40/60.

The component (a) is preferably a compound represented by formula (2):

$$R^1\text{-}[A\text{-}P]_n\text{—}[B\text{-}Q]_m\text{—}C\text{—}R^2 \cdot aX^- \quad (2)$$

wherein at least one of $R^1$ and $R^2$ is a $C_{8-36}$ alkyl or alkenyl group which may be interrupted by an ester group or an amide group, and the other group is a $C_{1-5}$ alkyl or hydroxyalkyl group; A, B and C each represent a group —$N^+(R^3)(R^4)$— or —$N(R^5)$— provided that at lest one of A, B and C is —$N^+(R^3)(R^4)$— and A, B and C are simultaneously not —$N^+(R^3)(R^4)$—, $R^3$, $R^4$ and $R^5$ are the same as or different from one another and represent a $C_{1-5}$ alkyl or hydroxyalkyl group; P and Q each represent a $C_{1-5}$ alkylene group which may be interrupted by an ester group, an ether group or an amide group or may be substituted with a hydroxy group or an ether group; "a" is the number of —$N^+(R^3)(R^4)$— groups in A, B and C; "n" is a number of 1 to 3, and "m" is a number of 0 to 2; and $X^-$ is an anion.

Alternatively, in the formula, at least one of $R^1$ and $R^2$ is a $C_{8-36}$ alkyl or alkenyl group which may be interrupted by an ester group or an amide group, and the other group is a $C_{1-5}$ alkyl or hydroxyalkyl group; A, B and C may be the same as or different from one another and each represent a group —$N^+(R^3)(R^4)$— or —$N(R^5)$—, $R^3$, $R^4$ and $R^5$ maybe the same as or different from one another and represent a $C_{1-5}$ alkyl or hydroxyalkyl group; P and Q each represent a $C_{1-5}$ alkylene group which may be interrupted by an ester group, an ether group or an amide group or may be substituted with a hydroxy group or an ether group; "a" is the number of —$N^+(R^3)(R^4)$— groups in A, B and C; "n" is a number of 1 to 3, and "m" is a number of 0 to 2; and $X^-$ is an anion.

The composition of the present invention can further comprise 0.5 to 20% by weight of a component (d) whose δ is 20 to 40 as determined by formula (1):

$$\delta=[(14820+99.2\ Tb+0.084\ Tb^2)/V]^{1/2} \quad (1)$$

wherein Tb is a boiling temperature (° K) and V is a molar volume ($cm^3$/mol) at 20° C.

Further, the present invention encompasses a composition which comprises 3 to 50% by weight of a compound having two or more quaternary ammonium groups or tertiary amino groups and one or more $C_{8-36}$ alkyl or alkenyl group in the molecule as the component (a), 0.5 to 30% by weight of an anionic surfactant as the component (b), 0.1 to 10% by weight of a nonionic surfactant as the component (c) and 0.5 to 20% by weight of the component (d).

DETAILED DESCRIPTION OF THE INVENTION

The embodiment (1) of the component (a) is a compound having one or more $C_{8-36}$ hydrocarbon groups and two or more groups selected from an amino group and a quaternary ammonium group in the molecule, and is preferably represented by the formula (2).

Alternatively, the component (a) is a compound having two or more, more preferably two or three and most preferably two groups selected from a quaternary ammonium group and a tertiary amino group and one or more, more preferably one or two and most preferably one group selected from $C_{8-36}$ alkyl and alkenyl groups, and it is the principal component for softening.

Preferable examples of such compounds include the following compounds:

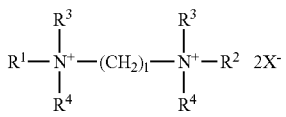

(I)

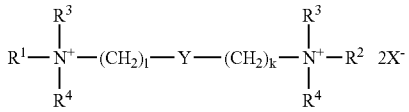

(II)

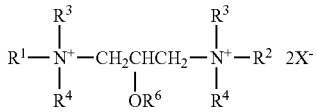

(III)

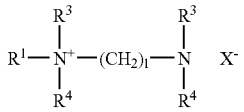

(IV)

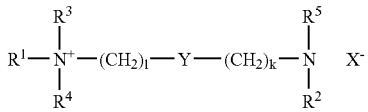

(V)

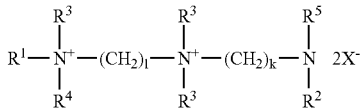

(VI)

wherein $R^1$ to $R^5$ and $X^-$ have the same meanings as defined above, $R^6$ is a hydrogen atom or a $C_{1-12}$ alkyl group or an oxyethylene group with an average condensation degree of 1 to 20; Y is a group selected from —COO—, —OCO—, —CONH—, —NHCO— and —O— and 1 and "k" may be the same as or different from each other and represent a number of 1 to 5.

Among the above compounds in the present invention, (I) (II), (IV) and (V) are preferable, and (II) and (V) are particularly preferable.

In the present invention it is also preferable that $R^1$ and/or $R^2$, preferably $R^1$ or $R^2$, is a $C_{14-24}$ alkyl or alkenyl group interrupted by an ester group and/or an amide group, and it is particularly preferably a group selected from $R^7$—COZ-$R^8$— and $R^7$-ZCO—$R^8$—. In the formula, $R^7$ is a $C_{13-19}$ alkyl or alkenyl group, and $R^8$ is an alkylene group containing 1 to 5 carbon atoms, preferably 1 to 3 carbon atoms. "Z" represents —O— or —NH—.

Among the compounds exemplified as the component (a), those compounds having a tertiary amino group may be the one whose tertiary amino group has been neutralized with an acid agent before incorporation into the softener composition. The acid for neutralization is preferably hydrochloric acid, sulfuric acid, phosphoric acid and fatty acid, particularly preferably hydrochloric acid and sulfuric acid.

As the embodiment (2) of the component (a) in the present invention, the component (a) and/or the component (b), preferably the component (a) or the component (b), more preferably the component (a), can have at least one hydrocarbon group selected from <1> a $C_{8-36}$ hydrocarbon group having one or more unsaturated bonds (hereinafter referred to as the hydrocarbon group <1>) and <2> a $C_{8-36}$ branched hydrocarbon group (hereinafter referred to as the hydrocarbon group <2>). When a plurality of the component (a) and/or (b) are used, at least one of these compounds may have at least one hydrocarbon group selected from the hydrocarbon group <1> and the hydrocarbon group <2>.

The hydrocarbon group <1> is preferably an oleyl group, an elaidyl group, a linol group, a linolen group, an erucyl group or a brassidyl group. Further, the hydrocarbon group <2> is preferably an isostearyl group, anisooleyl group or a Guerbet-type alkyl group, and it is preferable for feeling that the hydrocarbon group <1> is an oleyl group or an erucyl group and the hydrocarbon group <2> is an isostearyl group.

Further, such hydrocarbon groups <1> and <2> may be bound via an ester group, an ether group or an amide group to a quaternary ammonium group and/or an amino group in the component (a) or to an anion group in the component (b). Specifically, it is preferably a group represented by R'-T-R"— wherein R' is a hydrocarbon group selected from the hydrocarbon groups <1> and <2>; T is a group selected from —COO—, —OCO—, —CONH— and —NHCO—; and R" is a $C_{1-5}$ alkylene group. This group can be formed from R'COOH as the starting material. It is desirable for water absorption properties and feeling that R'COOH used as the starting material is a fatty acid selected from oleic acid, elaidic acid, linolic acid, linolenic acid, erucic acid, brassidic acid, isostearic acid, isooleic acid, and Guerbet-type fatty acid.

The component (a) in this embodiment is preferably a compound of formula (2) above. In the formula, $R^1$ and/or $R^2$ is a group selected from the hydrocarbon groups <1> and <2>, and when $R^1$ or $R^2$ is the hydrocarbon group <1> or <2>, the other group is a hydrogen atom or a $C_{1-5}$ alkyl or hydroxyalkyl group. A, B and C may be the same or different and each represent a group selected from —$N^+(R^3)(R^4)$— and —$N(R^5)$—. Here, $R^3$ and $R^4$ may be the same or different and represent a $C_{1-5}$ alkyl or hydroxyalkyl group, and $R^5$ is a hydrogen atom or a $C_{1-5}$ alkyl or hydroxyalkyl group. P and Q each represent a $C_{1-5}$ alkylene group which may be interrupted by an ester group or an amide group or may be substituted with a hydroxy group or an ether group. "a" is the number of —$N^+(R^3)(R^4)$— groups in A, B and C. "n" is a number of 1 to 3, and "m" is a number of 0 to 2. $X^-$ is an anion, preferably a halogen ion, a sulfate ion or a $C_{1-3}$ alkyl sulfate ion.

As the compound as the component (a), the compound whose amino group was neutralized with an acid agent can also be used. The acid for neutralization is preferably hydrochloric acid, sulfuric acid, glycolic acid, phosphoric acid, hydroxycarboxylic acid and fatty acid, more preferably hydrochloric acid, sulfuric acid and glycolic acid. This neutralization step may be conducted before or during compounding the composition.

The component (a) in this embodiment is preferably a compound represented by formulae (a-I) to (a-V):

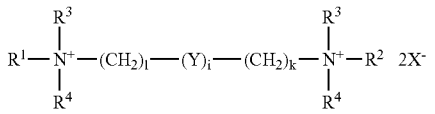

(a-I)

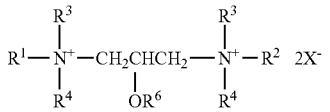

(a-II)

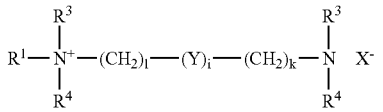

(a-III)

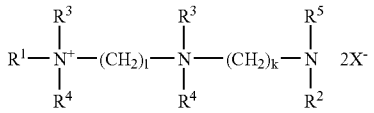

(a-IV)

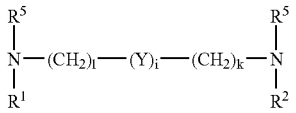

(a-V)

wherein $R^1$ to $R^5$ and $X^-$ have the same meanings as defined above; $R^6$ is a hydrogen atom, a $C_{1-12}$ alkyl group or a $C_{1-20}$ polyoxyethylene group with an average condensation degree of 1 to 20; Y is a group selected from —COO—, —OCO—, —CONH—, —NHCO— and —O—; and "l" is a number of 1 to 5, "k" is a number of 0 to 5, and "i" is a number of 0 or 1.

Among the above compounds in the present invention, (a-1), (a-III) and (a-V) are particularly preferable.

The embodiment (3) of the component (a) in the present invention is a compound having at least one $C_{8-36}$ hydrocarbon group, at least one quaternary ammonium group and at least one tertiary amino group in the molecule (a), wherein the cation equivalent of quaternary ammonium group in the component (a)/the anion equivalent in the component (b) is from 90/10 to 40/60.

Here, the cation equivalent refers to a proportion of quaternary ammonium group in one molecule of the compound as the component (a), and does not include cation group resulting from acid chlorination of tertiary amino group. The anion equivalent is a proportion of anion group in one molecule of the anionic surfactant as the component (b).

The component (a) in this embodiment is a compound having one or more, more preferably one or two and most preferably one quaternary ammonium group, tertiary amino group and $C_{8-36}$ alkyl or alkenyl group, respectively, and it is a major component for softening.

In particular, the compound of formula (2) above is preferable. In this formula, $R^1$ and/or $R^2$ is a $C_{8-36}$, preferably $C_{10-30}$, and particularly preferably $C_{14-24}$ alkyl or alkenyl group which may be interrupted by an ester or an amide group, and the other group is a $C_{1-5}$, preferably $C_{1-3}$ alkyl or hydroxyalkyl group. A, B and C each represent a group $—N^+(R^3)(R^4)—$ or $—N(R^5)—$. However, at lest one of A, B and C is $—N^+(R^3)(R^4)—$ and A, B and C are simultaneously not $—N^+(R^3)(R^4)—$. Here, $R^3$, $R^4$ and $R^5$ may be the same or different and represent a $C_{1-5}$, preferably $C_{1-3}$ alkyl or hydroxyalkyl group. P and Q each represent a $C_{1-5}$ alkylene group which may be interrupted by an ester group, an ether group or an amide group or may be substituted with a hydroxy group or an ether group. "a" is the number of $—N^+(R^3)(R^4)—$ groups in A, B and C. "n" is a number of 1 to 3, preferably 1 or 2, and "m" is a number of 0 to 2, preferably 0 or 1. $X^-$ is an anion, preferably a halogen ion, a $C_{1-3}$ alkyl sulfate ion and a fatty acid ion.

As the compound as the component (a), the compound whose tertiary amino group was neutralized with an acid agent before incorporation into the softener composition can also be used. The acid for neutralization is preferably hydrochloric acid, sulfuric acid, phosphoric acid and fatty acid, more preferably hydrochloric acid and sulfuric acid.

The component (a) in this embodiment is preferably a compound represented by formulae (22) to (24):

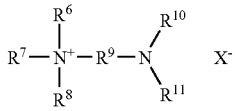

(22)

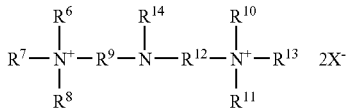

(23)

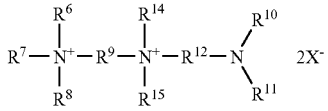

(24)

wherein one of $R^6$ and $R^{10}$ is a $C_{12-24}$, preferably $C_{14-24}$, alkyl or alkenyl group, and the other group is a $C_{1-3}$ alkyl or hydroxyalkyl group; $R^7$, $R^8$, $R^{11}$, $R^{13}$, $R^{14}$ and $R^{15}$ independently represent a $C_{1-3}$ alkyl or hydroxyalkyl group; $R^9$ and $R^{12}$ each represent a $C_{2-6}$, preferably $C_{2-5}$, alkylene group which may be interrupted by —COO—, —OCO—, $—CONR^{16}—$ or $—NR^{16}CO—$, preferably by the ester or amide group described above; $R^{16}$ represents a hydrogen atom or a $C_{1-3}$ alkyl group; and $X^-$ has the same meanings as defined above.

Specifically, the following compounds are mentioned.

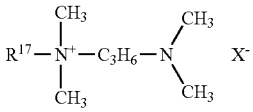

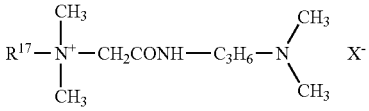

-continued

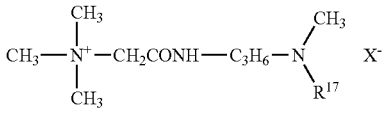

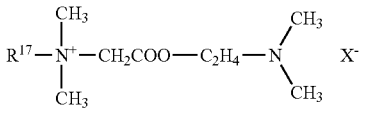

wherein $R^{17}$ is a $C_{14-20}$ alkyl or alkenyl group, and $X^-$ is a halogen ion.

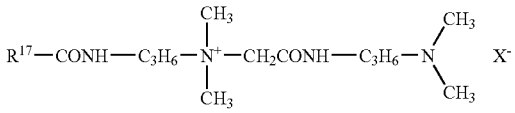

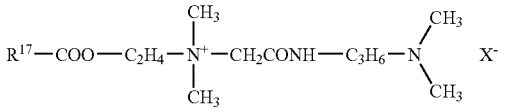

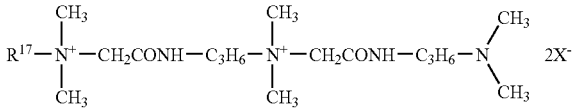

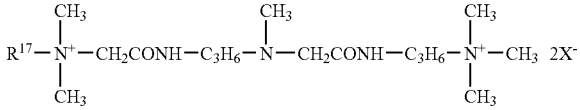

wherein $R^{17}$ is a $C_{14-20}$ alkyl or alkenyl group, and $X^-$ is a halogen ion.

The anionic surfactant as the component (b) in the present invention includes alkylbenzenesulfonic acid, alkylsulfuric acid, polyoxyalkylene alkyl ether sulfuric acid, olefin sulfonic acid, alkane sulfonic acid, saturated or unsaturated fatty acid, polyoxyalkylene alkyl or alkenyl ether carboxylic acid, α-sulfofatty acid, α-sulfofatty acid ester, and salts thereof. Among these compounds, it is preferable to compound one or more members selected from alkylsulfuric acid having an alkyl group containing 10 to 30 carbon atoms, preferably 12 to 24 carbon atoms and particularly preferably 14 to 24 carbon atoms, a polyoxyethylene alkyl ether sulfuric acid having an alkyl group containing 10 to 30 carbon atoms, preferably 12 to 24 carbon atoms, particularly preferably 14 to 24 carbon atoms and having about 1 to 6, preferably about 1 to 4, ethylene oxide molecules added thereto, and a saturated or unsaturated fatty acid containing 8 to 18 carbon atoms, as well as salts thereof.

Other examples include a fatty acid, an alkyl or alkenyl sulfate, an alkyl or alkenyl sulfonate, an alkyl benzene sulfonate, an alkyl or alkenyl phosphonate, an α-olefin sulfonate, a polyoxyethylene alkyl or alkenyl ether sulfate, a polyoxyethylene alkyl or alkenyl ether phosphonate, and a methyl α-sulfofatty acid ester, and these compounds may be in the form of their corresponding inorganic or organic salts or acids. The salts include sodium salt, potassium salt, ammonium salt, alkanolamine salt etc. Particularly preferable examples include an alkyl sulfate, a polyoxyethylene alkyl ether sulfate having about 1 to 6 ethylene oxide molecules added thereto, and an alkyl benzene sulfonate.

The alkyl or alkenyl group in the component (b) is a group selected from the hydrocarbon groups <1> and <2>, or is a straight-chain alkyl group containing 10 to 22 carbon atoms and preferably 10 to 20 carbon atoms, preferably a straight-chain alkyl group containing 12 to 20 carbon atoms.

The mixing ratio of the component (a) to the component (b) in the softener composition of the present invention, in terms of cation equivalent of quaternary ammonium group in the component (a)/anion equivalent in the component (b), is from 90/10 to 40/60, preferably from 70/30 to 50/50. In this range, good softness and feeling can be achieved. It is preferable for product stability and usability during use that the softener composition of the present invention comprises the components (a) and (b) in a total amount of preferably 3 to 40% by weight, the balance being water or various additives shown later. Water is contained in an amount of preferably 40 to 95% by weight, particularly 50 to 85% by weight. Further, the pH value of the softener composition of the present invention at 25° C. is preferably 1 to 5.

In the present invention, a nonionic surfactant is incorporated as the component (c). The nonionic surfactant is preferably a polyoxyalkylene alkyl ether having one or more $C_{8-20}$ alkyl or alkenyl groups, particularly preferably a nonionic surfactant represented by formula (4):

$$R^9\text{-}T\text{-}[(R^{10}O)_p\text{—}H]_q \quad (4)$$

wherein $R^9$ is an alkyl or alkenyl group containing 10 to 18 carbon atoms, preferably 12 to 18 carbon atoms; $R^{10}$ is an alkylene group containing 2 or 3 carbon atoms, preferably an ethylene group; "p" is an average number of units added, and is a number of 2 to 100, preferably 5 to 40 or 5 to 80, particularly preferably 20 to 40 or 10 to 60; T is —O—, —N— or —CON—, and when T is —O—, "q" is 1, and when T is —N— or —CON—, "q" is 2.

Examples of compounds of formula (4) include the following compounds.

$$R^9\text{—}O\text{—}(C_2H_4O)_r\text{—}H$$

wherein $R^9$ has the same meanings as defined above, "r" is an average number of units added, and is an number of 8 to 100, preferably 10 to 80 or 10 to 60.

$$R^9\text{—}O\text{—}(C_2H_4O)_s(C_3H_6O)_t\text{—}H$$

wherein $R^9$ has the same meanings as defined above, and "s" and "t" are average numbers of units added, and independently represent a number of 2 to 40, preferably 5 to 40, and the ethylene oxide and propylene oxide units may constitute a random or block addition product.

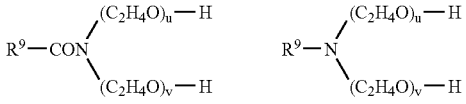

wherein $R^9$ has the same meanings as defined above, and the sum of "u" and "v" is a number of 5 to 100, preferably 5 to 80 or 10 to 80.

It is preferable for stability that the amount of the above nonionic surfactant incorporated into the composition is 0. 5 to 10% by weight, particularly preferably 1 to 8% by weight.

Further, the ratio by weight of the components (a) and (b) to the component (c), that is, ((a)+(b))/(c), is from 1/1 to 200/1, preferably 2/1 to 100/1, particularly preferably from 3/1 to 50/1.

As the component (d) in the present invention, use can be made of those compounds whose δ is 20 to 40, preferably 21 to 35, particularly preferably 21 to 27, as determined by formula (1) above.

Further, those compounds having a molecular weight of 100 to 400, preferably 130 to 300, particularly 150 to 300 and a boiling temperature of 150° C. or more, preferably 200 to 350° C., particularly 240 to 350° C., are preferable.

The δ value in the present invention is approximate to the solubility parameter and is described on pages 78 to 82 in "Yoeki To Yokaido" (Solution and Solubility) written by Kozo Shinoda and published on Apr. 30, 1991 by Maruzen Co., Ltd.

Preferable compounds satisfying the δ value in the present invention include an alkyl glyceryl ether having a $C_{3-8}$ alkyl group, a di- or triethylene glycol monophenyl ether, a di- or triethylene glycol monoalkyl ether having a $C_{2-8}$ alkyl group, 1,6-hexane diol, 2,5-hexane diol, 3-pentanone, cyclohexanol, 2-hexanol and 1-octanol, among which an alkyl glyceryl ether having a $C_{2-5}$ alkyl group, a di- or triethylene glycol monoalkyl ether having a $C_{2-5}$ alkyl group, and a triethylene glycol monophenyl ether are particularly preferable.

When the softener composition of the present invention comprises (d), the component (a) is contained in an amount of 3 to 50% by weight, preferably 3 to 40% by weight and particularly preferably 5 to 35% by weight. Further, the component (d) is contained in an amount of 0.5 to 20% by weight, preferably 1 to 15% by weight and particularly preferably 1 to 10% by weight. Further, the component (b) is contained in an amount of 0.5 to 30% by weight, preferably 1 to 20% by weight and particularly preferably 5 to 20% by weight. Further, the component (c) is contained in an amount of 0.1 to 10% by weight, preferably 0.5 to 8% by weight and particularly preferably 1 to 5% by weight.

Further, the ratio by weight of the component (a) to the component (b), that is, (a)/(b), is preferably from 10/1 to 1/5, particularly preferably from 5/1 to 1/2, in order to improve feeling, and the ratio by weight of the component (d) to the component (a), that is, (d)/(a) is preferably from 1/10 to 1/1, particularly preferably 1/5 to 1/1, in order to prevent gelation in an inlet. Further, the ratio by weight of the components (a) and (b) to the component (c), that is, ((a)+(b))/(c), is from 1/1 to 200/1, preferably 2/1 to 100/1, particularly preferably from 3/1 to 50/1.

The softener composition of the present invention is a composition comprising the components (a) to (d) and water, and the water is preferably ionic substance-free water such as distilled water or deionized water. For storage stability, the softener composition of the present invention comprises water in an amount of preferably 40 to 95% by weight, particularly preferably 50 to 90% by weight.

Further, it is preferable for storage stability that the softener composition of the present invention has a pH value of 2 to 5 at 20° C., particularly preferably 2.5 to 4.

For the purpose of further improving storage stability, the softener composition of the present invention is compounded preferably with an oil component. The oil component is preferably an ester compound between a fatty acid containing 8 to 20 carbon atoms or 8 to 22 carbon atoms, preferably 10 to 18 carbon atoms and a polyvalent alcohol, and particularly preferable examples include triglyceride, diglyceride, monoglycerides or mono-, di- or triesters of pentaerythritol, as well as a sorbitan esters. Such oil components are incorporated in an amount 0.05 to 10% by weight, particularly 0.1 to 5% by weight into the composition. Alternatively, their amount may be 0.1 to 10% by weight, particularly 0.5 to 5% by weight.

For storage stability, the softener composition of the present invention is compounded desirably with inorganic salts such as calcium chloride etc. in an amount of 0 to 1000 ppm, preferably 10 to 500 ppm. Sodium salts and potassium salts are contained in surfactants such as fatty acid salts etc., and inorganic salts mixed in the composition by using such surfactants are not subject to the above limitation.

The softener composition may be compounded with ingredients such as silicone, a perfume and a coloring matter which are usually incorporated into softener compositions.

For storage stability, it is also preferable in the present invention to compound a solvent component selected from ethanol, isopropanol, glycerin, ethylene glycol, propylene glycol, diethylene glycol, dipropylene glycol and polyoxyethylene phenyl ether. The composition is compounded with these solvent components in an amount of 0 to 20% by weight, particularly preferably 0.5 to 10% by weight. When ethanol is used, ethanol modified with polyoxyethylene alkyl ether sulfate or ethanol modified with 8-acetylated sucrose is preferably used.

In the softener composition of the present invention, silicone compounds such as polydimethyl siloxane and amine-modified polydimethyl siloxane can be incorporated as feeling improvers in an amount of 0.1 to 5% by weight. Further, when the composition is to be colored, a coloring agent such as acid dye, direct dye, basic dye or reactive dye selected from azo dye, anthraquinone dye, indigoid dye, phthalocyanine dye, carbonium dye, quinone imine dye, methine dye, quinoline dye, nitro dye, nitroso dye, benzoquinone dye, naphthoquinone dye, naphthalimide dye and perylone dye, or a Liquitint (registered trademark) dye produced by MILLIKEN Ltd., may be incorporated in an amount of 1 to 1000 ppm. Further, perfumes usually incorporated into fiber-treating agents may also be used, and for example, a combination of perfume components shown as components (c) and (d) described in JP-A 8-11387 is preferable. In addition, a defoaming agent, an antimicrobial agent etc. can be incorporated.

As another softening component, a cationic softening component having two long-chain alkyl groups which may be interrupted with an ester group or an amide group can be incorporated in an amount of 1 to 20% by weight.

As a storage stabilizer, a nonionic surfactant consisting of a $C_{8-20}$ primary or secondary alcohol having about 5 to 60 moles on the average of ethylene oxide added thereto is preferably incorporated in an amount of 0.1 to 10% by weight.

Further, monovalent and polyvalent alcohols such as ethanol, propanol, isopropanol, ethylene glycol, diethylene glycol, propylene glycol, butylene glycol, hexylene glycol, polyethylene glycol, glycerin, pentaerythritol and diglycerin are preferably incorporated in an amount of 0.1 to 20% by weight.

Further, inorganic electrolytes such as sodium chloride, potassium chloride, calcium chloride, magnesium chloride, ammonium chloride, sodium sulfate, potassium sulfate, ammonium sulfate, sodium nitrate, potassium nitrate, calcium nitrate, magnesium nitrate and ammonium nitrate are preferably incorporated in an amount of 0.01 to 5% by weight. These alcohols and inorganic electrolytes are used as phase stabilizers and viscosity regulators.

Perfumes can also be incorporated.

The softener composition of the present invention can endow various fibers, particularly cotton and cotton clothes, with preferable softness, elasticity (fluffy feeling) and a feel of dryness with less oiliness and is excellent in the feel (water absorption feeling) upon wiping hands with cotton towels treated therewith. Further, chemical fibers can be endowed with sufficient softness. In addition, discoloration by repeated washing can be prevented.

Hereinafter, Synthesis Examples 1 to 12 for the component (a) used in the Examples of the present invention are described.

SYNTHESIS EXAMPLE 1

Synthesis of (a-1)

a-1:

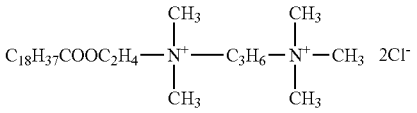

Methyl monoethanolamine and acrylonitrile were subjected in an usual manner to the Michael addition reaction, and the reaction product was introduced into an autoclave made of stainless steel, followed by adding ethanol as the solvent and Raney nickel as the catalyst. The atmosphere in the autoclave was replaced by nitrogen and then by hydrogen, and the mixture was reacted for 3 hours at a temperature of 110° C. at a pressure of 10 kg/cm$^2$ hydrogen. Then, an aqueous solution of formalin in a 2.2-fold molar amount relative to the amine was injected into the autoclave, and the reaction was further continued for 5 hours. After cooling, the resultant reaction product was distilled to give N-hydroxyethyl-N,N',N'-tetramethyl propane diamine.

Then, stearic acid and N-hydroxyethyl-N,N',N'-tetramethyl propane diamine were esterified by a conventional esterification method, and the resulting ester was subjected to quaternarization reaction with methyl chloride, to give Compound a-1.

SYNTHESIS EXAMPLE 2

Synthesis of (a-2)

a-2:

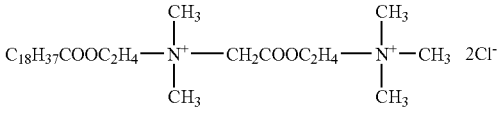

An esterification reaction product of dimethyl ethanolamine and stearic acid and an esterification reaction product of choline chloride and monochloroacetic acid were synthesized in an usual method. These 2 compounds were dissolved in equimolar amounts respectively in ethanol and reacted for 6 hours under reflux. The ethanol was distilled away under reduced pressure and the reaction product was purified in an usual manner to give Compound a-2.

SYNTHESIS EXAMPLE 3

Synthesis of (a-3)

a-3:

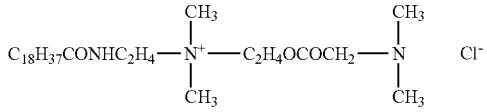

The dehydration condensation reaction of stearic acid with N-hydroxyethyl ethylene diamine was carried out, and the reaction product was hydrolyzed and distilled to give N-stearoyl-N'-hydroxyethyl ethylene diamine. It was dissolved in ethanol, and 1.1-fold equivalents (based on the amine) of formalin was added dropwise thereto under reflux, then 1.1-fold equivalents (based on the amine) of formic acid was added dropwise thereto, and the mixture was aged for 5 hours. The reaction product was further quaternarized with methyl chloride to give N-stearoylaminoethyl-N-hydroxyethyl-N,N-dimethyl ammonium chloride.

This compound and dimethyl glycine were subjected to usual esterification reaction to give Compound a-3.

SYNTHESIS EXAMPLE 4

Synthesis of (a-4)

a-4:

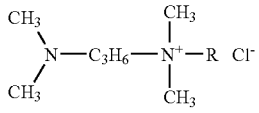

wherein R is an alkyl group from a tallow fatty acid.

1-Chloroalkane (150 g, 0.52 mol) and N,N,N',N'-tetramethyl-1,3-propane diamine (68 g, 0.53 mol) were mixed with ethanol (350.0 g) in a flask. After the mixture was refluxed for 72 hours, the ethanol was distilled away under reduced pressure, and the unreacted amine was removed. The resulting solid was recrystallized from acetone in an usual manner, whereby N-(3-dimethylaminopropyl)-N-alkyl-N,N-dimethyl ammonium chloride (180 g, 95 wt-% purity) was obtained.

SYNTHESIS EXAMPLE 5

Synthesis of (a-5)

a-5:

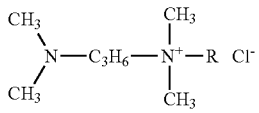

wherein R is an oleyl group.

1-Chloroalkane (150 g, 0.52 mol) and N,N,N',N'-tetramethyl-1,3-propane diamine (68 g, 0.53 mol) were mixed with ethanol (350.0 g) in a 1-L four-necked flask equipped with a thermometer, a dropping funnel and a condenser.

After the mixture was refluxed for 72 hours, the ethanol was distilled away under reduced pressure, and the unreacted amine was removed. The resulting solid was recrystallized from acetone in an usual manner, whereby N-(3-dimethylaminopropyl)-N-alkyl-N,N-dimethyl ammonium chloride (180 g, 95 wt-% purity) having the structure described later was obtained.

SYNTHESIS EXAMPLE 6

Synthesis of (a-6)

a-6:

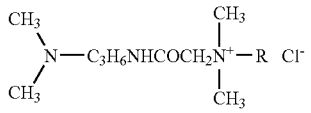

wherein R is an isostearyl group.

N,N-dimethyl alkyl amine (179 g, 0.60 mol) and acetone ((238.0 g) were introduced into a 1-L four-necked flask equipped with a thermometer, a dropping funnel and a condenser, and then dissolved by heating at 50° C. Thereafter, isopropyl monochloroacetate (99 g, 0.72 mol) was added dropwise thereto at 20° C. over the period of 5 minute, and the mixture was reacted for 4 hours under heating at 60° C. After the reaction was finished, the reaction solution was cooled to 20° C., and the resulting white crystals were further recrystallized from acetone in an usual manner, whereby N-(isopropoxycarbonylmethyl)-N,N-dimethyl alkyl ammonium chloride (214 g, 0.49 mol) was obtained.

The resulting N-(isopropoxycarbonylmethyl)-N,N-dimethyl alkyl ammonium chloride (207 g, 0.48 mol) was dissolved in 2-propanol (66 g) in a 1-L four-necked flask equipped with a thermometer and a condenser, and N,N-dimethyl-1,3-propane diamine (59 g, 0.57 mol) was added thereto and reacted for 5 hours under heating at 90° C.

After the reaction was finished, excess N,N-dimethyl-1,3-propane diamine and 2-propanol were distilled away under reduced pressure, whereby a solution of N-(3-dimethyl aminopropyl aminocarbonylmethyl)-N,N-dimethyl alkyl ammonium chloride (218.8 g, 97 weight-%) in 2-propanol was obtained.

SYNTHESIS EXAMPLE 7

Synthesis of (a-7)

a-7:

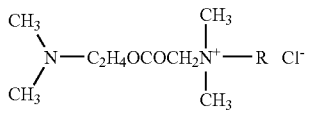

wherein R is an erucyl group.

N,N-dimethyl alkyl amine (179 g, 0.60 mol) was dissolved in ethanol (300 g) in a 1-L four-necked flask equipped with a thermometer, a dropping funnel and a condenser, and ethyl bromoacetate (117 g, 0.60 mol) was added dropwise thereto. Thereafter, the mixture was reacted by heating under ethanol reflux until the starting amine disappeared in TLC. After the reaction was finished, the ethanol was distilled away.

Then, the reaction solution was introduced into a 1-L four-necked flask equipped with a thermometer and a condenser, and then hydrolyzed by adding 81.6 g aqueous solution containing 6.5 g KOH. Disappearance of the starting quaternary salt was confirmed in HPLC., and the reaction solution was neutralized with 20% sulfuric acid. Water was distilled away under reduced pressure, and the purified salt was collected by filtration. Then, this salt was dissolved in 500 ml dichloromethane, and 335 g thionyl chloride was added dropwise thereto at room temperature and reacted under reflux for 1 hour. When the solvent and an excess of the thionyl chloride were distilled away, an orange oily residue was obtained. This residue was dissolved in 800 ml dimethoxyethane, and dimethyl ethanolamine (69 g, 0.77 mol) was added thereto and reacted under reflux for 1 hour. After the reaction, the resulting white precipitates were collected by filtration and washed several times with acetone, followed by distilling the acetone away with an evaporator to give N-(acetoxyethyl dimethylamino)-N-alkyl-N,N-dimethyl ammonium chloride hydrochloride (152 g, 92 weight-% purity) as white powder.

SYNTHESIS EXAMPLE 8

Synthesis of (a-8)

a-8:

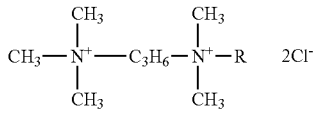

wherein R is an isostearyl group.

Alkyl amine (142 g, 0.5 mol) was dissolved in ethanol (250 g) in a 1-L four-necked flask equipped with a thermometer, a dropping funnel and a condenser, and 29.2 g acrylonitrile was added dropwise thereto in about 1 hour under reflux, followed by aging for 3 hours. From the reaction solution, the ethanol and unreacted acrylonitrile were removed by an evaporator. Then, 1% (based on the amine) by weight of Raney nickel, 150 g of the above reaction product and 150 g of water/IPA (ratio of 50/50 by volume) were introduced into an autoclave (made of stainless steel), and after the atmosphere in the autoclave was replaced by $N_2$ and then by $H_2$, the mixture was reacted at a temperature of 110° C. at a pressure of 10 kg/cm$^2$ $H_2$ for 6 hours. After cooling, the water/IPA was distilled away with an evaporator, and the reaction product was distilled to give N-alkyl ethylene diamine. Then, 50 g (0.1531 mol) of this compound, 500 g of ethanol/water (ratio of 90/10 by volume) and 56.8 g of water-free soda ash were introduced into an autoclave, and 42.5 g of methyl chloride was injected into the autoclave at 80° C. After the injection, the reaction solution was aged at 80° C. for 6 hours and then cooled, and the inorganic salt was separated by filtration, and the solvent was distilled away under reduced pressure. The resulting compound was washed several times with acetone, and the acetone was distilled away with an evaporator, whereby the title compound (purity: 96% by weight) was obtained.

SYNTHESIS EXAMPLE 9

Synthesis of (a-11)

a-11:

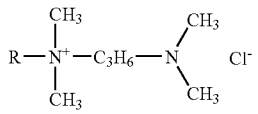

wherein R is a mixed $C_{16}$ and $C_{18}$ alkyl group.

1-Chloroalkane (150 g, 0.52 mol) as a $C_{16}/C_{18}$ mixture in a ratio of 60:40 by weight and N,N,N',N'-tetramethyl-1,3-propane diamine (68 g, 0.53 mol) were mixed with ethanol (350.0 g) in a 1-L four-necked flask equipped with a thermometer, a dropping funnel and a condenser. After the mixture was refluxed for 72 hours, the ethanol was distilled away under reduced pressure, and the unreacted amine was removed. The resulting solid was recrystallized from acetone in an usual manner, whereby N-(3-dimethylamino-propyl)-N-alkyl-N,N-dimethyl ammonium chloride (180 g, 95 weight-% purity) shown later was obtained.

SYNTHESIS EXAMPLE 10

Synthesis of (a-12)

a-12:

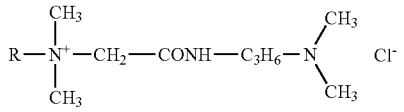

wherein R is a $C_{16}$ or $C_{18}$ alkyl group.

N,N-dimethyl alkyl amine (179 g, 0.60 mol) ($C_{16}$- and $C_{18}$-alkyl amine, that is, a mixture of $C_{16}$ straight-chain alkyl amine/$C_{18}$ straight-chain alkyl amine in a ratio of 60:40 by weight) and acetone (238.0 g) were introduced into a 1-L four-necked flask equipped with a thermometer, a dropping funnel and a condenser, and the mixture was dissolved by heating at 50° C. Thereafter, isopropyl monochloroacetate (99 g, 0.72 mol) was added dropwise thereto at 20° C. over the period of 5 minutes and reacted for 4 hours under heating at 60° C. After the reaction was finished, the reaction solution was cooled to 20° C., and the resulting white crystals were recrystallized from acetone in an usual manner, whereby N-(isopropoxycarboxymethyl)-N,N-dimethyl alkyl ammonium chloride (214 g, 0.49 mol) was obtained. The resulting N-(isopropoxycarboxymethyl)-N,N-dimethyl alkyl ammonium chloride (207 g, 0.48 mol) was dissolved in 2-propanol (66 g) in a 1-L four-necked flask equipped with a thermometer and a condenser, and N,N-dimethyl-1,3-propane diamine (59 g, 0.57 mol) was added thereto and reacted for 5 hours under heating at 90° C. After the reaction was finished, excess N,N-dimethyl-1,3-propane diamine and 2-propanol were distilled away under reduced pressure, whereby a solution of N-(3-dimethylaminopropylaminocarboxymethyl)-N,N-dimethyl alkyl ammonium chloride (218.8 g, 97 weight-% purity) shown above in 2-propanol was obtained.

SYNTHESIS EXAMPLE 11

Synthesis of (a-13)

a-13:

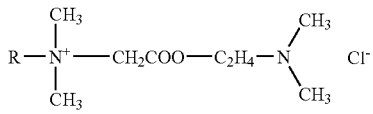

wherein R is a $C_{16}$ or $C_{18}$ alkyl group.

N,N-dimethyl alkyl amine (the same as in Synthesis Example 2. 179 g, 0.60 mol) was dissolved in ethanol (300 g) in a 1-L four-necked flask equipped with a thermometer, a dropping funnel and a condenser, and ethyl bromoacetate (117 g, 0.60 mol) was added dropwise thereto. Thereafter, the mixture was heated and reacted under ethanol ref lux until the starting amine disappeared in TLC. After the reaction was finished, the ethanol was distilled away.

Then, the reaction solution was introduced into a 1-L four-necked flask equipped with a thermometer and a condenser, and then hydrolyzed by adding 81.6 g aqueous solution containing 6.5 g KOH. Disappearance of the starting quaternary salt was confirmed in HPLC, and the reaction solution was neutralized with 20% sulfuric acid. Water was distilled away under reduced pressure, and the purified salt was collected by filtration. Then, this salt was dissolved in 500 ml dichloromethane, and 335 g thionyl chloride was added dropwise thereto at room temperature and reacted under reflux for 1 hour. When the solvent and an excess of the thionyl chloride were distilled away, an orange oily residue was obtained. This product was dissolved in 800 ml dimethoxyethane, and dimethyl ethanolamine (69 g, 0.77 mol) was added thereto and reacted under reflux for 1 hour. After the reaction, the resulting white precipitates were collected by filtration and washed several times with acetone, followed by distilling the acetone away with an evaporator, to give the title compound N-(acetoxyethyldimethylamino)-N-alkyl-N,N-dimethyl ammonium chloride hydrochloride (152 g, 92 weight-% purity) as white powder.

SYNTHESIS EXAMPLE 12

Synthesis of (a-14)

a-14:

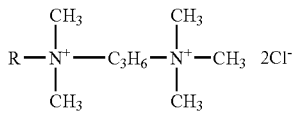

wherein R is a $C_{16}$ or $C_{18}$ alkyl group.

Alkyl methylamine (142 g, 0.5 mol) ($C_{16}$- and $C_{18}$-alkyl amine) was dissolved in ethanol (250 g) in a 1-L four-necked flask equipped with a thermometer, a dropping funnel and a condenser, and 29.2 g acrylonitrile was added dropwise thereto in about 1 hour under reflux and aged for 3 hours. From the reaction solution, the ethanol and unreacted acrylonitrile were removed by an evaporator. Then, 1% (based on the amine) by weight of Raney nickel, 150 g of the above reaction product and 150 g of water/IPA (50/50 vol.) were introduced into an autoclave (made of stainless steel), and after the atmosphere in the autoclave was replaced by $N_2$ and then by $H_2$, the mixture was reacted at a temperature of 110° C. at a pressure of 0.98 MPa $H_2$ for 6 hours. After cooling, the water/IPA was distilled away with an evaporator, and the reaction product was distilled to give N-alkyl propylene diamine. Then, 50 g (0.1531 mol) of this compound, 500 g of ethanol/water (90/10 vol.) and 56.8 g of water-free soda ash were introduced into an autoclave, and 42.5 g methyl chloride was injected into the autoclave at 80° C. After the injection, the reaction solution was aged at 80° C. for 6 hours and then cooled, and the inorganic salt was separated by filtration, and the solvent was distilled away under reduced pressure. The resulting compound was washed several times with acetone, and the acetone was distilled away with an evaporator, whereby the title compound (purity: 96% by weight) was obtained.

SYNTHESIS EXAMPLE 13

Compound (a-15) was obtained in the same manner as in Synthesis Example 1 except that oleic acid was used in place of stearic acid.

a-15:

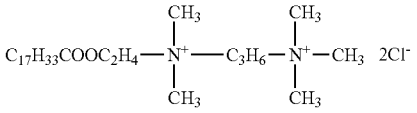

Hereinafter, the examples of the composition of the present invention are described.

EXAMPLE 1

The above compounds a-1 to a-4 and the following compounds were used to prepare the softener compositions in Table 1. a-9: Alkyl amino propyl amine having the following structure

[Diamine RRT produced by Kao Corporation]

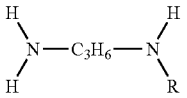

wherein R is cetyl group/stearyl group/(oleyl group+elaidyl group)=31/22/47 (ratio by weight).

a-10: The same compound as a-8 except that R is an alkyl group derived from hydrogenated tallow fatty-acid.

a'-1: Dioleyl dimethyl ammonium chloride b-1: Sodium stearyl sulfate b-2: Sodium polyoxyethylene (average number of ethylene oxide units added: 2.5) stearyl ether sulfate b-3: Sodium stearate b-4: Sodium octadecyl sulfonate b-5: Sodium isostearate b-6: Sodium octadecyl carboxylate c-1: A compound having about 21 ethylene oxide units added to a $C_{12}$ saturated alcohol c-2: A compound having about 20 ethylene oxide units added to diethanol amide of lauric acid d-1: $C_8H_{17}OCH_2CH(OH)CH_2OH$(δ=21.96)

d-2: $C_5H_{11}OCH_2CH(OH)CH_2OH$(δ=23.27)

d-3: 1,6-Hexane diol(δ=27.23)

d-4: Triethylene glycol monophenyl ether (δ=20.92)

e-1: A mixture of glyceryl mono-, di- and tristerarates (mono:

di: tri=60:35:5)

f-1: Calcium chloride f-2: Coloring matter (Acid Blue 9)

f-3: Perfume.

The respective compositions prepared above were tested in the following manner.

<Softening Treatment Method>

Five bath towels (100% cotton) were washed using a commercial weakly alkaline detergent (Attack™, Kao Corporation) in a laundry machine (two-tank system laundering machine VH-360S1 manufactured by Toshiba Corp.; detergent concentration, 0.0667% by weight; 30 L tap water was used; water temperature, 20° C.; 10 minutes). Thereafter, the wash was discharged and the towels were dehydrated for 1 minute. After 30 L tap water was poured into the tank, the towels were rinsed for 5 minutes, the water was discharged, and the towels were dehydrated for 1 minute. Then, 30 L tap water was again poured into the tank, and 7 g of a composition in Table 1 was added thereto and stirred for 5 minutes. Thereafter, the towels were dehydrated and air-dried.

<Evaluation of Feeling>

The feeling of the bath towels thus treated was evaluated using the following criteria by a panel of 10 persons (5 males in thirties and 5 females in twenties) to determine a mean value. ○ was assigned to a mean value of less than 1, Δ was assigned to a mean value of 1 or more to less than 1.5, and was assigned to a mean value of 1.5 or more. The results are shown in Table 1.

Light feeling without oiliness . . . 0

Light feeling with slight oiliness . . . 0

Oily feeling . . . 2

Very oily feeling . . . 3.

<Evaluation of Gelation-Preventing Effect>

A 100-ml polypropylene beaker produced by Sansho Ltd. was weighed, and 10 ml softener composition in Table 1 was introduced into it and then the beaker was left upside down for 12 hours. 10 ml additional softener composition was introduced into it and the beaker left upside down for 12 hours. By leaving the beaker upside down in this way, the softener composition was discharged from the beaker, but a certain amount of the softener composition remained adhering to the wall surface of the beaker. This operation was repeated 5 times, and the beaker after the final operation was weighed. An increase in the weight of the beaker was determined using the following equation. A less increase in the weight indicates higher inhibition of gelation.

Increase in the weight=(final weight of the beaker*−initial weight of the beaker)/initial weight of the beaker×100 (%) *Final weight of the beaker is the weight after the final operation.

<Softening Treatment Method>

The compositions and their test results are shown in Table 1. Water comprises a pH regulator and deionized water. The pH is a value at 20° C.

TABLE 1

| | present invention | | | | | comparison | | | |
|---|---|---|---|---|---|---|---|---|---|
| | 1 | 2 | 3 | 4 | 5 | 1 | 2 | 3 | 4 |
| Softener composition component (weight %) | | | | | | | | | |
| a-1 | 15 | | | | | 15 | | | |
| a-2 | | 15 | | | 5 | | 15 | | |
| a-3 | | | 15 | | | | | | |
| a-4 | | | | 15 | | | | | |
| a'-1 | | | | | | | | 15 | 15 |
| b-1 | 10 | | | | 10 | 10 | | | |
| b-2 | | 10 | | | | | | | |
| b-3 | | | 10 | 10 | | | | | 10 |
| c-1 | 2 | | 2 | | 2 | | | 2 | 2 |
| c-2 | | 2 | | 2 | | | 2 | | |
| d-1 | 5 | | | | 1 | | | | |
| d-2 | | 5 | | | | | 5 | | |
| d-3 | | | 5 | | | | | 5 | 5 |
| d-4 | | | | 5 | | | | | |
| e-1 | 1 | 1 | 1 | 1 | 1 | | 1 | 1 | 1 |
| f-1 | 100 ppm | 100 ppm | 100 ppm | 100 ppm | 100 ppm | 100 ppm | 100 ppm | 100 ppm | 100 ppm |
| f-2 | 10 ppm | 10 ppm | 10 ppm | 10 ppm | 10 ppm | 10 ppm | 10 ppm | 10 ppm | 10 ppm |
| f-3 | 0.1 | 0.1 | 0.1 | 0.1 | 0.1 | 0.1 | 0.1 | 0.1 | 0.1 |
| water | Balance | Balance | balance | balance | balance | balance | balance | balance | Balance |
| total | 100 | 100 | 100 | 100 | 100 | 100 | 100 | 100 | 100 |
| pH | 2.5 | 3.5 | 4.5 | 3.5 | 2.5 | 2.5 | 3.5 | 4.5 | 4.5 |
| Feeling in touch | ○ | ○ | ○ | ○ | ○ | Δ | Δ | x | Δ |
| Gelation-preventing effect (%) | 10 | 12 | 9 | 10 | 10 | 26 | 18 | 20 | 22 |

EXAMPLE 2

Using the components a-5 to a-10, b-1, b-4 and b-5 described above and components described later, the softener compositions in Table 1 were prepared and tested.

<Preparation of the Compositions>

2.5% by weight of a nonionic surfactant [component (c)] having about 20 molecules of ethylene oxide added to lauryl alcohol (Kalcol 2098 produced by Kao Corporation) and 3.0% by weight of ethylene glycol [component (d), δ=37.9] were added to water at 65° C., and the components (a) and (b) in Table 1 were added thereto under stirring with stirring blades. Thereafter, 10 ppm coloring matter (Acid Blue 9), 0.3% by weight of a perfume [that is, a mixture of hexyl cinnamic aldehyde (18) nerolin yarayara (4), tricyclodecenyl acetate (4), benzyl acetate (10), musk ketone (5), anisyl acetone (2), sandal mysolcore (2), aldehyde C14 peach (1), linalool (18), dihydroxy myrcenol (8), borneol (4), cedrol (4), mugoal (5), benzyl alcohol (5), and dipropylene glycol (10); weight-% in the perfume is shown in the brackets] and 0.1% by weight of silicone (TSA730 produced by J. E. Toshiba Silicone Ltd.) were added thereto. Each mixture was adjusted to a predetermined pH value with hydrochloric acid or sodium hydroxide and then cooled to give each of the desired compositions. The resulting compositions were evaluated in the following manner. The results are shown in Table 2.

<Treating Method>

1 kg of commercially available cotton towels and 0.5 kg of jersey clothes made of acrylate fibers were laundered repeatedly 5 times with a commercially available detergent Attack™ (Kao Corporation) in hard water of 3.5° DH at 20° C. in a laundering machine having a capacity of 30 liters. Then, 7 g softener composition (the balance was water) shown in Table 1 was introduced thereinto at the time of final rinsing, followed by treating the towels and jersey clothes under stirring for 3 minutes. The cotton towels and jersey cloths made of acrylate fibers treated in this manner were air-dried at room temperature and then left in a constant temperature and humidity chamber at 25° C. under 45% RH for 24 hours.

<Evaluation Method>

The softness and oiliness of the resulting clothes were evaluated in a constant temperature and humidity chamber at 25° C. under 45% RH by a paired comparison test using clothes treated with 7 g of a softener composition containing 15% by weight of di-hydrogenated tallow alkyl dimethyl ammonium chloride (the balance was water) as the control. In addition, the water absorption properties of clothes obtained in the same manner as above were also evaluated in the paired comparison test by wiping hands with the clothes. Evaluation was conducted by 10 examiners, and the evaluation results were averaged and ranked according to the following criteria. The results are shown in Table 1.

Criteria for Evaluation of Softness

+2: Softener than the control.

+1: Somewhat softener than the control.

0: Equal to the control.

−1: Somewhat harder than the control.

−2: Harder than the control.

Criteria for Evaluation of Oiliness

+2: Less oily than the control.

+1: Somewhat less oily than the control.

0: Equal to the control.

−1: Somewhat more oily than the control.

−2: More oily than the control.

Criteria for Evaluation of Water Absorption Properties

+2: Superior in water absorption properties to the control.

+1: Somewhat superior in water absorption properties to the control.

0: Equal to the control.

−1: Somewhat inferior in water absorption properties to the control.

−2: Inferior in water absorption properties to the control.

Averaging Treatment

◎: Higher by 1.0 to 2.0 than mean value.

○: higher by up to 1.0 than mean value.

Δ: Mean value.

x: Lower by up to 1.0 than mean value.

xx: Lower by 1.0 to 2.0 than mean value.

The compositions and their test results are shown in Table 2.

TABLE 2

| | (a) component | | (b) component | | (a)/(b) molar | pH | cotton towel | | |
|---|---|---|---|---|---|---|---|---|---|
| | kind | Weight % | Kind | weight % | ratio | (25° C.) | softening | oiliness | water absorption feeling |
| present invention | | | | | | | | | |
| 1 | a-5 | 11 | b-1 | 9 | 54/46 | 3.5 | Δ | ◎ | ◎ |
| 2 | a-5 | 14 | b-1 | 6 | 69/31 | 2.5 | Δ | ◎ | ◎ |
| 3 | a-5 | 14 | b-4 | 6 | 68/32 | 2.5 | Δ | ◎ | ◎ |
| 4 | a-5 | 14 | b-5 | 6 | 65/35 | 2.5 | Δ | ◎ | ◎ |
| 5 | a-6 | 14 | b-1 | 6 | 65/35 | 2.5 | Δ | ◎ | ◎ |
| 6 | a-7 | 14 | b-1 | 6 | 63/37 | 2.5 | Δ | ◎ | ◎ |
| 7 | a-8 | 14 | b-1 | 6 | 65/35 | 4.0 | Δ | ◎ | ◎ |
| 8 | a-9 | 15 | b-1 | 5 | 62/38* | 2.5 | Δ | ◎ | ◎ |
| 9 | a-10 | 14 | b-5 | 6 | 61/39 | 4.0 | Δ | ◎ | ◎ |
| 10 | a-15 | 17 | b-1 | 3 | 79/21 | 4.0 | Δ | ◎ | ◎ |
| comparison | | | | | | | | | |
| 1 | a-5 | 19 | b-1 | 1 | 95/5 | 2.5 | x | ◎ | ◎ |
| 2 | a-5 | 6 | b-1 | 14 | 29/71 | 2.5 | x x | ◎ | ◎ |
| 3 | a-5 | 20 | — | — | 100/0 | 2.5 | x | ◎ | ◎ |
| 4 | a-10 | 14 | b-1 | 6 | 61/39 | 4.5 | Δ | ◎ | Δ |

*The mole ratio (a)/(b) of the invention No. 8 is a mole ratio of the compound having an unsaturated hydrocarbon group of (a-9) to (b-1).

EXAMPLE 3

<Preparation of Softener Compositions>

Each of the compounds (a-11) to (a-14) synthesized by the method described above and an anionic surfactant selected from b-1, b-4 and b-6 were blended in the compounding amounts shown in Table 3, and further 1% by weight of ethanol [component (d) δ=32.1], 2% by weight of ethylene glycol [component (d), δ=37.9], 0.1% by weight of sodium chloride, 0.001% by weight of a dye (Acid Blue 112), 0.02% by weight of a silicone compound [KST104 (polydimethyl siloxane) produced by J. E. Toshiba Silicone] and 2% by weight of a polyoxyethylene lauryl ether (component c-1 having about 21 molecules of ethylene oxide added thereto) were added thereto and adjusted with hydrochloric acid to each pH value shown in Table 1. The balance was water.

<Treating Method>

2 kg of commercially available cotton towels and 1 kg of jersey clothes made of acrylate fibers were laundered repeatedly 5 times with a commercially available detergent Attack™ (Kao Corporation) in hard water of 3.5° DH in a laundering machine having a capacity of 30 liters. Then, 20 g of a softener composition show in Table 1 was introduced thereinto at the time of final rinsing, followed by treating the towels and jersey clothes under stirring at 20° C. for 3 minutes. Separately, 1.0 kg of commercially available dark-blue polo shirt (material: cotton) and 3 kg of weight-regulated clothes (cotton/artificial fibers=3/2) were laundered with a commercially available detergent Attack™ (Kao Corporation) in hard water of 3.5° DH in a laundering machine having a capacity of 30 liters, and 20 g of a softener composition shown in Table 1 was introduced thereinto at the time of final rinsing, followed by treating the shirt and clothes under stirring at 20° C. for 3 minutes. This operation was repeated 10 times.

<Evaluation Method>

The cotton towels and jersey cloths made of acrylate fibers treated in the method described above were air-dried at room temperature and then left in a constant temperature and humidity chamber at 25° C. under 45% RH for 24 hours. Then, the softness and oiliness of the resulting clothes were evaluated by a paired comparison test under the following criteria where clothes treated with 20 g softener composition compounded with 15% by weight of dialkyl ($C_{16}$- and $C_{18}$-alkyl group) dimethyl ammonium chloride in place of (a-11) to (a-14) and not compounded with the component (b) were used as the control. The clothes were evaluated by a panel of 10 persons to determine a mean value.

+2: Softener or less oily than the control.

+1: Somewhat softener or somewhat less oily than the control.

0: Equal to the control.

−1: Somewhat harder or somewhat more oily than the control.

−2: Harder or more oily than the control.

◎: the mean value is +1.0 or more.

○: the mean value is zero to less than +1.0.

Δ: the mean value is zero.

□:the mean value is −1.0 to less than zero.

x: the mean value is less than −1.0.

The dark-blue polo shirt treated in the method described above was air-dried at room temperature and then left in a constant temperature and humidity chamber at 25° C. under 45% RH for 24 hours. Then, the discoloration of the resultant polo shirt was evaluated in a paired comparison test under the following criteria where clothes treated with 20 g softener composition compounded with 15% by weight of dialkyl ($C_{16}$- and $C_{18}$-alkyl group) dimethyl ammonium chloride in place of (a-1) to (a-4) and not compounded with the component (b) were used as the control. The polo shirt was evaluated by a panel of 10 persons to determine a mean value.

+2: Less discoloration than the control.
+1: Somewhat less discoloration than the control.
0: Equal to the control.
−1: Somewhat more discoloration than the control.
−2: More discoloration than the control.
◎: the mean value is +1.0 or more.
○: the mean value is zero to less than +1.0.
Δ: the mean value is zero.
□: the mean value is −1.0 to less than zero.
x: the mean value is less than −1.0.

The compositions and their test results are shown in Table 3. In Table 3, *the equivalent ratio of (a)/(b) is the cation equivalent of the quaternary ammonium group of the component (a) to the anion equivalent of the component (b). **pH is a value at 25° C. of the softener composition, adjusted with a hydrochloric acid solution.

TABLE 3

| | (a) component | | (b) component | | (a)/(b) | | cotton towel | | Acrylic | polo shirt discoloration- |
|---|---|---|---|---|---|---|---|---|---|---|
| | kind | amount (weight %) | kind | amount (weight %) | equivalent ratio | pH** | softening function | oiliness | cloth Softness | preventing effect |
| present invention | | | | | | | | | | |
| 1 | a-11 | 12 | b-1 | 8 | 57/43 | 2.5 | ○ | ◎ | ○ | ◎ |
| 2 | a-11 | 12 | b-4 | 8 | 56/44 | 3.0 | ○ | ◎ | ○ | ◎ |
| 3 | a-11 | 12 | b-6 | 8 | 50/50 | 3.5 | ○ | ◎ | ○ | ◎ |
| 4 | a-12 | 12 | b-1 | 8 | 56/44 | 2.5 | ○ | ◎ | ○ | ◎ |
| 5 | a-13 | 12 | b-1 | 8 | 55/45 | 3.0 | ○ | ◎ | ○ | ◎ |
| 6 | a-11 | 16 | b-1 | 4 | 78/22 | 3.5 | Δ | ◎ | ○ | ◎ |
| comparison | | | | | | | | | | |
| 1 | a-11 | 19 | b-1 | 1 | 94/6 | 2.5 | □ | ◎ | □ | ○ |
| 2 | a-11 | 6 | b-1 | 14 | 27/73 | 2.5 | x | ◎ | x | Δ |
| 3 | a-11 | 20 | — | — | 100/0 | 2.5 | □ | ◎ | □ | ○ |
| 4 | a-14 | 12 | b-1 | 8 | 70/30 | 7.0 | ○ | ◎ | Δ | Δ |
| 5 | a-11 | 12 | b-1 | 0.6 | 94/6 | 2.5 | □ | ◎ | □ | Δ |

The invention claimed is:

1. A softener composition which comprises a compound having one or more $C_{8-36}$ hydrocarbon groups and two or more groups selected from an amino group and a quaternary ammonium group in the, molecule (component (a)), an anionic surfactant having a $C_{8-36}$ hydrocarbon group (component (b)) and a nonionic surfactant (component (c)), wherein the molar ratio of the component (a) to the component (b) is from 90/10 to 54/46, wherein the component (a) is a compound having at least one $C_{8-36}$ hydrocarbon group, at least one quaternary ammonium group and at least one tertiary amino group, and the cation equivalent of the quaternary ammonium group of the component (a) to the anion equivalent of the component (b) is from 90/10 to 40/60, wherein the component (a) is a compound represented by the formula (2):

$$R^1\text{-}[A\text{-}P]_n\text{—}[B\text{-}Q]_m\text{—}C\text{—}R^2.aX^- \quad (2)$$

wherein at least one of $R^1$ and $R^2$ is a $C_{8-36}$ alkyl or alkenyl group which may be interrupted by an amide group, and the other group is a $C_{1-5}$ alkyl or hydroxyalkyl group when only one of $R^1$ and $R^2$ is a $C_{8-36}$ alkyl or alkenyl group interrupted by an amide group; A, B and C each represent a group $—N^+(R^3)(R^4)—$ or $—N(R^5)—$ provided that at least one of A, B and C is $—N^+(R^3)(R^4)—$ and A, B and C are simultaneously not all $—N^+(R^3)(R^4)—$, $R^3$, $R^4$ and $R^5$ are the same as or different from one another and represent a $C_{1-5}$ alkyl or hydroxyalkyl group; P and Q each represent a $C_{1-5}$ alkylene group which may be interrupted with an amide group; "a" is the number of $—N^+(R^3)(R^4)—$ groups in A, B and C; "n" is a number of 1 to 3, and "m" is a number of 0 to 2; and $X^-$ is an anion.

2. The composition as claimed in claim 1, which further comprises 0.5 to 20% by weight of a component (d) whose δ is 20 to 40 as determined by the formula (1):

$$\delta=[(14820+99.2\ Tb+0.084\ Tb^2)/V]^{1/2} \quad (1)$$

wherein Tb is a boiling temperature (° K) and V is a molar volume ($cm^3$/mol) at 20° C.

3. The composition as claimed in claim 2, which comprises 3 to 50% by weight of a compound having two or more quaternary ammonium groups or tertiary amino groups and one or more $C_{10-22}$ alkyl or alkenyl group(s) in the molecule as the component (a), 0.5 to 30% by weight of an anionic surfactant as the component (b), 0.1 to 10% by weight of a nonionic surfactant as the component (c) and 0.5 to 20% by weight of the component (d).

4. The composition as claimed in claim 1, wherein in the formula (2), one of $R^1$ and $R^2$ is a $C_{8-36}$ alkyl or alkenyl group which may be interrupted by an amide group, and the other group is a $C_{1-5}$ alkyl or hydroxyalkyl group; A, B and C may be the same as or different from one another and each represent a group $—N^+(R^3)(R^4)—$ or $—N(R^5)—$, $R^3$, $R^4$ and $R^5$ may be the same as or different from one another and represent a $C_{1-5}$ alkyl or hydroxyalkyl group; P and Q each represent a $C_{1-5}$ alkylene group which may be interrupted by an amide group; "a" is the number of $—N^+(R^3)(R^4)—$ groups in A, B and C; "n" is a number of 1 to 3, and "m" is a number of 0 to 2; and $X^-$ is an anion.

5. The composition as claimed in claim 1, wherein each of $R^1$ and $R^2$ are uninterrupted and unsubstituted, and each of P and Q are uninterrupted and unsubstituted.

6. The composition as claimed in claim 1, wherein each of $R^1$ and $R^2$ are interrupted by an amide group.

* * * * *